US011447712B2

(12) United States Patent
Ke et al.

(10) Patent No.: US 11,447,712 B2
(45) Date of Patent: *Sep. 20, 2022

(54) LUBRICANT COMPOSITIONS AND METHODS FOR USING THE SAME

(71) Applicant: ECOLAB USA INC., St. Paul, MN (US)

(72) Inventors: Wei Ke, Shanghai (CN); Liang Ji, Shanghai (CN); Yubao Liu, Shanghai (CN)

(73) Assignee: ECOLAB USA INC., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/153,445

(22) Filed: Jan. 20, 2021

(65) Prior Publication Data

US 2021/0214636 A1 Jul. 15, 2021

Related U.S. Application Data

(63) Continuation of application No. 15/735,861, filed as application No. PCT/CN2016/109683 on Dec. 13, 2016, now Pat. No. 10,927,322.

(51) Int. Cl.
*C10M 107/34* (2006.01)
*C10M 169/04* (2006.01)
(Continued)

(52) U.S. Cl.
CPC ..... *C10M 107/34* (2013.01); *C10M 169/04* (2013.01); *C10M 173/025* (2013.01);
(Continued)

(58) Field of Classification Search
CPC ..... C10M 169/04; C10M 173/025; C10M 2201/085; C10M 2207/125;
(Continued)

(56) References Cited

U.S. PATENT DOCUMENTS 5,441,654 A 8/1995 Rossio
5,863,874 A 1/1999 Person Hei et al.
(Continued)

FOREIGN PATENT DOCUMENTS

CN 1194664 A 9/1998
CN 101137742 A 3/2008
(Continued)

OTHER PUBLICATIONS

International Search Report and Written Opinion of the International Searching Authority for corresponding International Patent Application No. PCT/CN2016/109683 dated Sep. 25, 2017, 9 pages.

*Primary Examiner* — James C Goloboy
(74) *Attorney, Agent, or Firm* — Merchant & Gould P.C.

(57) ABSTRACT

A lubricant composition with improved stability and tolerance for water hardness comprises a synthetic wax emulsion; an amine derivative; an emulsifier; and a sequestrant. The synthetic wax emulsion may include poly(ethyleneoxide)-based or poly(propyleneoxide)-based wax emulsions. The amine derivative may include alkyl $C_{12}$-$C_{14}$ oxy propyl diamine. The lubricant composition can be used for lubricating the passage of a container along a conveyor. The method includes applying the lubricant composition to at least a part of the container or the conveyor in an application cycle, where the application cycle includes a first period of time of dispensing the lubricant composition and a second period of time of not dispensing the lubricant composition.

20 Claims, 3 Drawing Sheets

(51) Int. Cl.

| | |
|---|---|
| ***C10M 173/02*** | (2006.01) |
| ***C10N 10/02*** | (2006.01) |
| ***C10N 30/02*** | (2006.01) |
| ***C10N 40/00*** | (2006.01) |

(52) U.S. Cl.
CPC ..... *C10M 2201/085* (2013.01); *C10M 2207/125* (2013.01); *C10M 2209/084* (2013.01); *C10M 2209/1033* (2013.01); *C10M 2209/1045* (2013.01); *C10M 2215/042* (2013.01); *C10M 2219/022* (2013.01); *C10M 2219/044* (2013.01); *C10M 2219/104* (2013.01); *C10M 2223/02* (2013.01); *C10N 2010/02* (2013.01); *C10N 2030/02* (2013.01); *C10N 2040/38* (2020.05)

(58) Field of Classification Search
CPC .... C10M 2009/084; C10M 2009/1033; C10M 2009/1045; C10M 2215/042; C10M 2219/022; C10M 2219/044; C10M 2219/104; C10M 2223/03; C10N 2010/02; C10N 2030/02; C10N 2040/38
See application file for complete search history.

(56) References Cited

U.S. PATENT DOCUMENTS

| | | | |
|---|---|---|---|
| 5,935,914 | A | 8/1999 | Theyssen et al. |
| 6,288,012 | B1 | 9/2001 | Li et al. |
| 6,427,826 | B1 | 8/2002 | Li et al. |
| 6,485,794 | B1 | 11/2002 | Li et al. |
| 6,495,494 | B1 | 12/2002 | Li et al. |
| 6,509,302 | B2 | 1/2003 | Li et al. |
| 6,576,298 | B2 | 6/2003 | Bennett et al. |
| 6,673,753 | B2 | 1/2004 | Person et al. |
| 6,780,823 | B2 | 8/2004 | Li et al. |
| 6,806,240 | B1 | 10/2004 | Hei et al. |
| 6,821,568 | B2 | 11/2004 | Bennett et al. |
| 7,557,071 | B2 | 7/2009 | Sarkis et al. |
| 10,927,322 | B2 * | 2/2021 | Ke ..... C10M 169/04 |
| 2004/0029741 | A1 | 2/2004 | Corby et al. |
| 2004/0167044 | A1 | 8/2004 | Ruhr et al. |
| 2005/0003973 | A1 | 1/2005 | Lewis et al. |
| 2005/0070448 | A1 | 3/2005 | Kupper et al. |
| 2006/0089274 | A1 | 4/2006 | Sarkis |
| 2007/0066497 | A1 | 3/2007 | Morrison |
| 2012/0073907 | A1 | 3/2012 | Seemeyer |
| 2016/0145532 | A1 | 5/2016 | Petlyuk et al. |

FOREIGN PATENT DOCUMENTS

| | | | |
|---|---|---|---|
| CN | 101517050 | A | 8/2009 |
| CN | 103966002 | A | 8/2014 |
| CN | 105358664 | A | 2/2016 |
| JP | S58-179295 | A | 10/1983 |
| JP | 10-504846 | | 5/1998 |
| JP | 2001-64666 | | 3/2001 |
| JP | 2008-509249 | | 3/2008 |
| JP | 2008-106253 | | 5/2008 |
| JP | 2008-518045 | | 5/2008 |
| JP | 2010-503747 | | 2/2010 |
| JP | 2013-36043 | | 2/2013 |
| JP | 2018-12782 | | 1/2018 |
| WO | 96/00767 | | 1/1996 |
| WO | 01/07544 | A1 | 2/2001 |
| WO | 2006/017503 | | 2/2006 |
| WO | 2006/046970 | | 5/2006 |
| WO | 2008/032284 | | 3/2008 |
| WO | 2008/048198 | | 4/2008 |

* cited by examiner

LUBRICANT COMPOSITIONS AND METHODS FOR USING THE SAME

CROSS-REFERENCE TO RELATED APPLICATIONS

This application is a continuation of U.S. application Ser. No. 15/735,861, filed Dec. 12, 2017, (now U.S. Pat. No. 10,927,322, issued on Feb. 23, 2021), which is a 371 of PCT/CN2016/109683, filed Dec. 13, 2016, the disclosures of which are incorporated by reference in their entirety.

FIELD

The present disclosure relates to conveyor lubricants and to methods for conveying articles. The disclosure also relates to conveyor systems and containers wholly or partially coated with such lubricant compositions.

BACKGROUND

In commercial container filling or packaging operations, the containers typically are moved by a conveying system at very high rates of speed. Traditionally, lubrication is provided to the conveying system by diluting a concentrated lubricant composition with water to form an aqueous dilute lubricant solution (i.e., dilution ratios of 100:1 to 1000:1), and dispensing copious amounts of aqueous dilute lubricant solution, also known as a "wet lubricant," to the conveyor or containers using spraying or pumping equipment. Conveyors or containers may also be lubricated by using an undiluted or "dry lubricant." These lubricant compositions permit high-speed operation of the conveyor and limit marring of the containers or labels.

Conveyor lubricants are constantly evolving in an effort to meet increasing demands from filling and packaging plants. Specifically, the standards that conveyor lubricants have to meet in terms of compatibility with various materials, including glass, metals (e.g., stainless steel), plastics, (e.g., poly(ethylene terephthalate) (PET)); the environment surrounding a conveyor line; cost of making and using the lubricant composition and dispensing the lubricant composition; and complexity of making and using the lubricant composition, including complexity of the lubricant dispensing system, have become more rigorous. Some dry and semi-dry lubricants have been seen as meeting at least some of the increased demands. However, there remains a need for even better conveyor lubricants that are less complicated and less costly to make and to use.

Diluted ("wet") lubricants have the benefit of providing an effective way of lubricating conveyor surfaces while using less of the concentrated lubricant composition. However, diluting lubricants with copious amounts of water is environmentally unfriendly. The presence of wet surfaces and standing water provides a medium for the growth of microorganisms including bacteria, yeast, and mold. Puddles of excess lubricant solution on floors create a hazard for slipping and falling.

"Dry lubes" have been described in the past as a solution to the disadvantages of dilute aqueous lubricants. A "dry lube" historically has referred to a lubricant composition with less than 50% water that was applied to a container or a conveyor without dilution. Methods of applying conveyor lubricants without in line dilution are described, for example, in U.S. Pat. Nos. 6,288,012; 6,427,826; 6,485,794; 6,495,494; 6,509,302; 6,576,298; 6,673,753; 6,780,823; 6,806,240; 6,821,568; U.S. Patent Applications 2004/0029741A1 and 2005/0003973A1; and PCT Patent Application 01/07544. However, dry lubricants are not suitable for all applications.

Semi-dry lubricant compositions have been developed as an alternative to wet and dry lubricants. The semi-dry lubricants provide a compromise between wet and dry lubricants, as the semi-dry lubricants can provide excellent lubricating performance with less dilution than wet lubricants, they can be applied with ordinary non-energized nozzles, be sustainably manufactured and used, provide water savings, help maintain hygiene, and reduce chemical consumption. There remains a need for improved semi-dry lubricant formulas. It is against this background that the present disclosure is made.

SUMMARY

The present disclosure relates generally to lubricant compositions and to methods of making and using lubricant compositions. The present disclosure further relates to lubricant compositions with improved stability and tolerance for water hardness. The lubricant composition comprises a synthetic wax emulsion; an amine derivative; an emulsifier; and a sequestrant. The synthetic wax emulsion may include poly(ethyleneoxide)-based or poly(propyleneoxide)-based wax emulsions. The amine derivative may include alkyl $C_{12}$-$C_{14}$ oxy propyl diamine. The lubricant composition can be used for lubricating the passage of a container along a conveyor. The method includes applying the lubricant composition to at least a part of the container or the conveyor in an application cycle, where the application cycle includes a first period of time of dispensing the lubricant composition and a second period of time of not dispensing the lubricant composition.

DETAILED DESCRIPTION

Figure 1A:
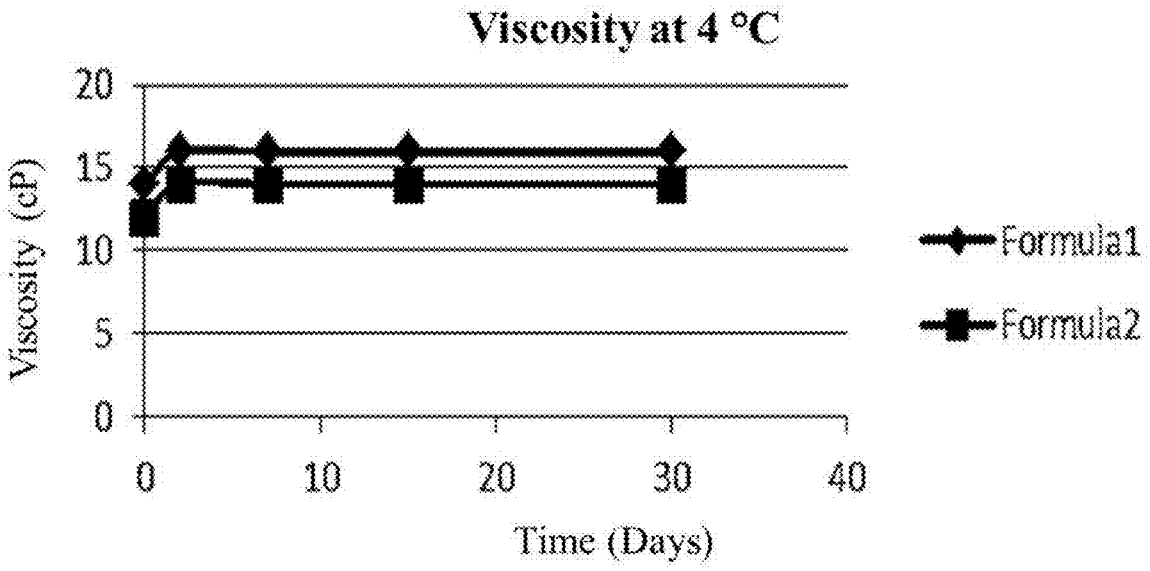
FIGS. 1A-1D are graphical representations of data from Example 1.
Figure 1B:
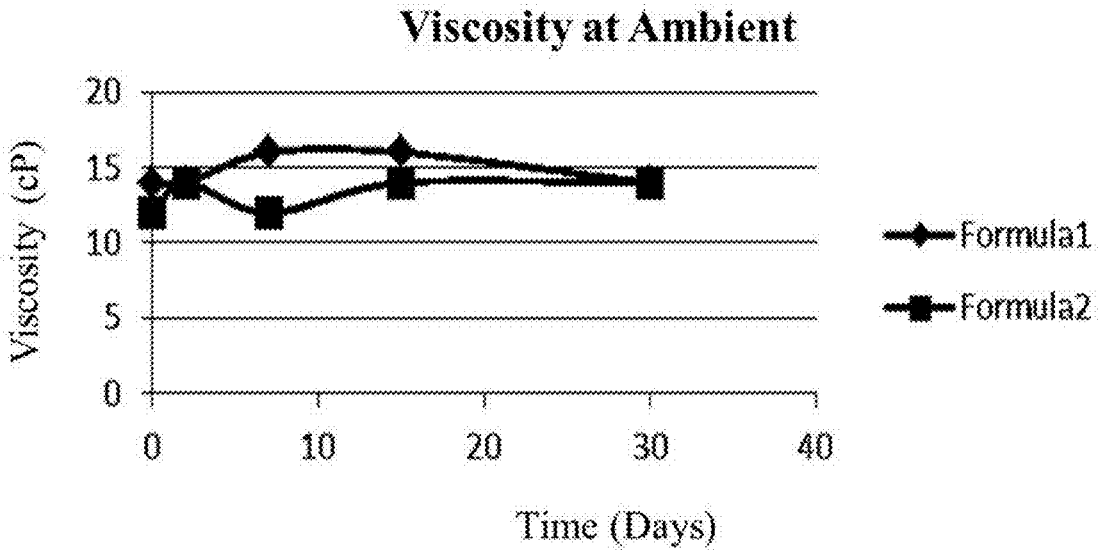
Figure 1C:
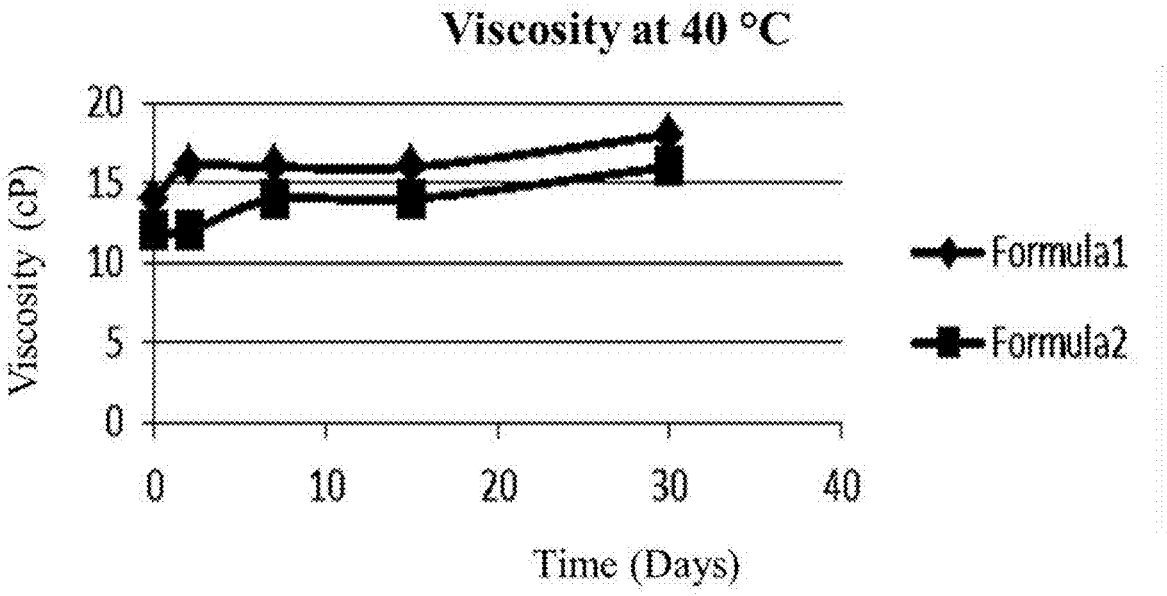
Figure 1D:
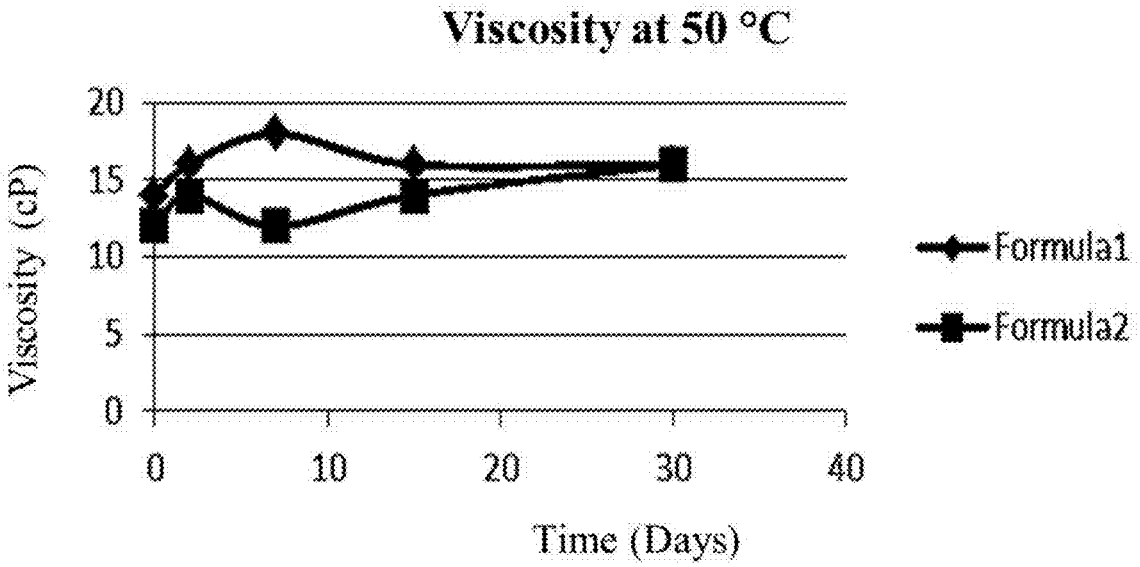

The present disclosure relates generally to lubricant compositions and to methods of making and using lubricant compositions. The present disclosure further relates to lubricant compositions with improved stability and tolerance for water hardness.

The present disclosure relates to lubricant compositions with improved temperature stability over broad temperature ranges (e.g., below 4° C. and above 50° C.), freeze-thaw stability, and ease of manufacture. The lubricant composition may also provide improved compatibility with water hardness ions. Compared to prior art wet lubricants, the lubricant composition of the present disclosure can provide 65% water savings and 44% overall cost savings to users, while significantly improving hygiene of the conveyor operation.

The term "about" is used here in conjunction with numeric values to include normal variations in measurements as expected by persons skilled in the art, and is understood have the same meaning as "approximately" and to cover a typical margin of error, such as ±5% of the stated value.

As used herein, "weight percent," "wt-%," "percent by weight," "% by weight," and variations thereof refer to the concentration of a substance as the weight of that substance in relation to the total weight of the composition. It is understood that, as used here, "percent," "%," and the like are intended to be synonymous with "weight percent," "wt-%," etc.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

The transitional phrase "consisting essentially of" as used in the claims limits the scope of the claim to the specified materials including only minor impurities or inactive agents that a person of ordinary skill in the relevant art would ordinarily associate with the listed components.

Some existing emulsion lubricants provide excellent lubricity performance on stainless steel chains, but suffer from drawbacks related to stability of the emulsion. For example, the emulsion can be temperature sensitive, with micelles breaking at high and low temperatures and leading to separation of the emulsion and an increase of the viscosity of the composition. The emulsion may also be difficult to dilute with water due to formation of flocs and precipitation, which may cause clogging of dispensing systems.

The present disclosure provides a lubricant emulsion that maintains the performance of the prior art lubricants but exhibits improved stability and dilution performance. The lubricant composition comprises an emulsion that is stable at temperatures below 4° C. and above 50° C., and can be diluted with water at a ratio of up to 1:1000.

The lubricant composition of the present disclosure is a temperature-stable emulsion. For example, the lubricant composition may be stable at temperatures ranging from about −40° C. to about 60° C. or from about −20° C. to about 55° C. The lubricant composition emulsion may also be stable through one or more freeze-thaw cycles. For example, the lubricant composition emulsion may be stable through 1 to 10 freeze-thaw cycles, or through at least 3 freeze-thaw cycles without visible separation of the emulsion.

The lubricant composition may include one or more lubricating agents, an emulsifier, and a sequestrant. The components are preferably selected so that they provide the composition with improved stability and tolerance for water hardness.

A variety of water-miscible lubricating agents can be employed in the lubricant compositions, including synthetic wax emulsions; amines and their derivatives, such as fatty amines, ether amines and amine salts; fatty acids; and phosphate esters.

Suitable synthetic waxes include polyethylene-based and polypropylene-based polymers, such as poly(ethylene oxide), polyethylene, poly(propylene oxide) and polypropylene, and copolymers of ethylene and propylene, such as ethylene-maleic copolymers (e.g., polyethylene-graft-maleic anhydride), and propylene-maleic copolymers (e.g., polypropylene-graft-maleic anhydride), and the like. The synthetic wax can be provided as an emulsion. In one embodiment, the synthetic wax includes oxidized polyethylene wax emulsion. Some lubricating waxes can also serve as thickening agents, such as waxes having a molecular weight of 200 or greater, e.g., about 200 to about 100,000, about 1,000 to about 80,000, about 5,000 to about 60,000, or about 10,000 to about 40,000. In one exemplary embodiment, the lubricating agent includes poly(ethylene oxide) having a molecular weight of 20,000 or greater, is used as lubricant and thickening agent. The synthetic wax emulsions can also act to protect the conveyor from corrosion.

In some embodiments, the lubricant composition is free of or substantially free of natural waxes. Natural waxes include, for example, vegetable based waxes, such as carnauba wax, candelilla wax, cotton seed wax, bayberry wax, myrtle wax, palm kernel wax, and Japan wax, and animal and insect waxes, such as beeswax, Chinese wax, lanolin, tallow-based waxes (e.g., stearin), and the like.

Suitable amine or amine derivative lubricants include fatty amines, ether amines and amine salts, such as oleyl diaminopropane, alkyl $C_{12}$-$C_{14}$ oxy propyl diamine or coco diaminopropane, lauryl propyl diamine, dimethyl lauryl amine, and PEG coco amine. Such amine derivative lubricants are available, for example, from Akzo Nobel Surface Chemistry LLC, the trade name DUOMEEN®, from Air Products and Chemicals, Inc. in Allentown, Pa. under the trade name TOMAMINE®. In one exemplary embodiment, the amine derivatives include fatty amines of the formula $R—NH—(CH_2)_3—NH_2$, where R is a C6-C20 linear or branched alkyl/alkenyl. In another exemplary embodiment, the amine derivatives include ether amines of the formula $R^1—O—R^2—NH—(CH_2)_3—NH_2$, where $R^1$ is a C6-C18 linear or branched alkyl or alkenyl, and $R^2$ is a linear or branched C1-C8 alkyl.

Besides lubricants, amines and amine derivatives can act as antimicrobial agents, which are particularly useful for conveyor systems.

In one aspect, the lubricant composition includes a combination of two or more lubricating agents. For example, the lubricant composition may include a combination of a synthetic wax emulsion and an amine or amine derivative. In one exemplary embodiment, the lubricant composition includes a polyethylene wax emulsion and alkyl diaminopropane.

The lubricant composition is formulated to include lubricating agents in an effective amount for lubricating the passage of containers on a conveyor line. The lubricant composition can be prepared as a concentrate that is diluted with water or another aqueous diluent prior to use (or upon application), or as a more dilute formulation that is applied without further dilution.

The lubricant composition may include from about 0.2 to about 90%, or from about 1 to about 75%, from about 2 to about 50%, or from about 5 to about 30% lubricating agents. In an example where the lubricant composition includes a first lubricating agent that is a synthetic wax emulsion and a second lubricating agent that is an amine or amine derivative, the first lubricating agent may be present at about 1 to about 60%, and the second lubricating agent may be present at about 0.1 to about 10%. The first and second lubricating agents can be present at a ratio of about 1 to about 30 parts, about 2 to about 20 parts, or about 3 to about 10 parts of the first lubricating agent for every 1 part of the second lubricating agent. In one example, the lubricant composition includes about 7 to about 8 parts of first lubricating agent for every 1 part of the second lubricating agent.

The lubricant composition may include one or more antimicrobial agents. Spillage of beverages, such as sodas and beers, on the conveyor often results in the growth of bacteria, yeast, and mold, and may create a slime and/or soil. Antimicrobial agents are useful for reducing slime formation on conveyor systems and their surrounding areas. Examples of suitable antimicrobial agents include amines and amine derivatives, such as fatty amine or ether amine and amine salts; amine acetate; quaternary ammonium compounds; guanidine; isothiazolinone and the like.

The lubricant composition may comprise from about 0.1 to about 20%, from 0.2 to about 15%, from 0.5 to about 10%, or from 1 to about 5% of antimicrobial agents.

The lubricant composition may include one or more emulsifiers, stabilizing agents, and coupling agents to help keep the composition homogeneous under a broad temperature range. Various different types of compounds can be used as emulsifiers or stabilizers. Examples of suitable stabilizers include alcohols, such as isopropyl alcohol or ethanol, ethoxylated alcohols, urea, esters, ethers (e.g., diethyl ether), and the like. Suitable emulsifiers include various surfactants, such as cationic, anionic, or nonionic surfactants. In some aspects, the same component can act as both an emulsifier and a stabilizer. Exemplary surfactants that can act as both an emulsifier and a stabilizer include alkyl sulfonates, alcohol ethoxylates, and alkyl ethoxy carboxylates.

The lubricant composition may comprise from about 0.1 to about 20, from 0.2 to about 15, from 0.5 to about 10, or from 1 to about 5% of emulsifiers or stabilizers. In one aspect, the lubricant composition includes about one part of emulsifier or stabilizer for every 5 to 40, or for every 10 to 25 parts of lubricating agents.

Examples of suitable cationic surfactants include amines, such as alkylamines and amido amines. The amine group includes, for example, alkylamines and their salts, alkyl imidazolines, ethoxylated amines, and quaternary ammonium compounds and their salts. Other cationic surfactants include sulfur (sulfonium) and phosphorus (phosphonium) based compounds that are analogous to the amine compounds.

Cationic surfactants generally refer to compounds containing at least one long carbon chain hydrophobic group and at least one positively charged nitrogen. The long carbon chain group may be attached directly to the nitrogen atom by simple substitution; or indirectly by a bridging functional group or groups in so-called interrupted alkylamines and amido amines. Such functional groups can make the molecule more hydrophilic or more water dispersible, more easily water solubilized by co-surfactant mixtures, or water soluble. For increased water solubility, additional primary, secondary or tertiary amino groups can be introduced or the amino nitrogen can be quarternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn as:

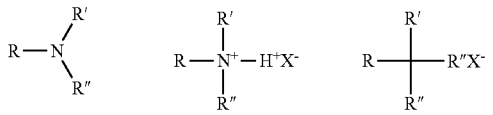

in which, R represents a long alkyl chain, R', R'', and R''' may be either long alkyl chains or smaller alkyl or aryl groups or hydrogen and X represents an anion.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties including detergency in compositions of or below neutral pH, antimicrobial efficacy, thickening or gelling in cooperation with other agents, and the like.

Exemplary cationic surfactants include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

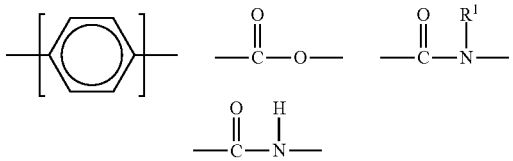

or an isomer or mixture of these structures, and which contains from 8 to 22 carbon atoms. The $R^1$ groups can additionally contain up to 12 ethoxy groups; m is a number from 1 to 3. Preferably, no more than one R group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y can be a group, such as one of the following:

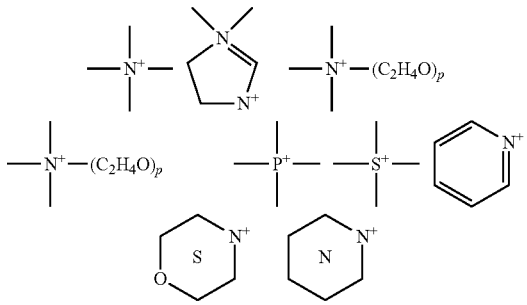

p = 1 to 12 or a mixture thereof. Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

The composition may include one or more anionic surfactants. Anionic surfactants are useful as detersive surfactants, but also as gelling agents or as part of a gelling or thickening system, as solubilizers, and for hydrotropic effect and cloud point control. Suitable anionic surfactants for the lubricant composition include: carboxylic acids and their salts, such as alkanoic acids and alkanoates, ester carboxylic acids (e.g. alkyl succinates), ether carboxylic acids, and the like; phosphoric acid esters and their salts; sulfonic acids and their salts, such as isethionates, alkylaryl sulfonates, alkyl sulfonates, sulfosuccinates; and sulfuric acid esters and their salts, such as alkyl ether sulfates, alkyl sulfates, and the like.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). The first class includes acylamino acids (and salts), such as acylglutamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like. Exemplary anionic surfactants include the following:

Linear and branched primary and secondary alkyl sulfates, alkyl ethoxysulfates, fatty oleyl glycerol sulfates, alkyl phenol ethylene oxide ether sulfates, the C5-C17 acyl-N—(C1-C4 alkyl) and —N—(C1-C2 hydroxyalkyl) glucamine sulfates, and sulfates of alkylpolysaccharides such as the sulfates of alkylpolyglucoside.

Ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants such as alkyl ethoxy carboxylates, the alkyl polyethoxy polycarboxylate surfactants and the soaps (e.g. alkyl carboxyls). Secondary soap surfactants (e.g. alkyl carboxyl surfactants) include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic surfactants include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

In one aspect, the lubricant composition includes an olefin sulfonate or a salt thereof. For example, the lubricant composition may include a long chain alkene sulfonate or long chain hydroxyalkane sulfonate, such as C14-C16 olefin sulfonate or a salt thereof. In some embodiments, the lubricant composition comprises from about 0.1 to about 20%, from 0.2 to about 15%, from 0.5 to about 10%, or from 1 to about 5% of a C14-C16 olefin sulfonate.

In one aspect, the lubricant composition includes an alkyl ethoxy carboxylate or a salt thereof. For example, the lubricant composition may include polyoxyethylene alkylether carboxylic acid (e.g., oleth-10 carboxylic acid) or a salt thereof. In some embodiments, the lubricant composition comprises from about 0.1 to about 20%, from 0.2 to about 15%, from 0.5 to about 10%, or from 1 to about 5% of polyoxyethylene alkylether carboxylic acid.

In one aspect, the lubricant composition includes phosphoric acid esters and salts thereof. For example, the lubricant composition may include C8-10 alcohol ethoxylated phosphates or a salt thereof. In some embodiments, the lubricant composition comprises from about 0.1 to about 20%, from 0.2 to about 15%, from 0.5 to about 10%, or from 1 to about 5% of a C8-10 alcohol ethoxylated phosphates.

Examples of suitable nonionic surfactants include block polyoxypropylene-polyoxyethylene polymeric compounds, including commercially available products PLURONIC© and TETRONIC® manufactured by BASF Corp. in Florham Park, N.J.; condensation products of alkyl phenol with ethylene oxide (e.g., alkyl polyglucosides), including commercially available products IGEPAL® manufactured by Rhone-Poulenc and TRITON© manufactured by Union Carbide; condensation products of a straight or branched chain alcohol having from 6 to 24 carbon atoms with ethylene oxide (e.g., alcohol ethoxylates), including commercially available products NEODOL© manufactured by Shell Chemical Co. and ALFONIC® manufactured by Vista Chemical Co.; condensation products of straight or branched chain carboxylic acid with ethylene oxide, including commercially available products NOPALCOL® manufactured by Henkel Corporation and LIPOPEG® manufactured by Lipo Chemicals, Inc.; and alkanoic acid esters formed by reaction with glycerides, glycerin, and polyhydric alcohols.

Particular examples of non-foaming, low foaming, or defoaming nonionic surfactants include: block polyoxypropylene-polyoxyethylene polymeric compounds with hydrophobic blocks on the outside (ends) of the molecule, sometimes referred to as "reverse" Pluronics or Tetronics, marketed under the trade names PLURONIC® R and TETRONIC® R; and nonionic surfactants modified by "capping" or "end blocking" terminal hydroxyl groups by reaction with a small hydrophobic molecule or by converting terminal hydroxyl groups to chloride groups. Other examples of non-foaming nonionic surfactants include alkylphenoxypolyethoxyalkanols; polyalkylene glycol condensates; defoaming nonionic surfactants having a general formula $Z[(OR)_nOH]_z$ where Z is alkoxylatable material, R is a radical, n is 10-2,000, and z is determined by the number of reactive oxyalkylatable groups; conjugated polyoxyalkylene compounds; and conjugated polyoxyalkylene compounds.

In one aspect, the lubricant composition includes alcohol ethoxylates. For example, the lubricant composition may include C12-15 ethoxylated alcohols. In some embodiments, the lubricant composition comprises from about 0.1 to about 20%, from 0.2 to about 15%, from 0.5 to about 10%, or from 1 to about 5% of ethoxylated alcohols.

In one aspect, the lubricant composition includes alkyl polyglucosides. For example, the lubricant composition may include decyl octyl D-glucose. In some embodiments, the lubricant composition comprises from about 0.1 to about 20%, from 0.2 to about 15%, from 0.5 to about 10%, or from 1 to about 5% of alkyl polyglucosides.

The lubricant composition may include one or more sequestrants to improve hard water compatibility of the lubricant composition. Examples of suitable sequestrants include phosphonic acids and phosphonates, phosphates, aminocarboxylates and their derivatives, pyrophosphates, polyphosphates, ethylenediamene and ethylenetriamine derivatives, hydroxyacids, and mono-, di-, and tri-carboxylates and their corresponding acids. Other sequestrants include aluminosilicates, nitroloacetates and their derivatives, and mixtures thereof. Still other sequestrants include aminocarboxylates, including salts of ethylenediaminetetraacetic acid (EDTA), hydroxyethylenediaminetetraacetic acid (HEDTA), and diethylenetriaininepentaacetic acid. In one aspect, the sequestrant includes EDTA (including tetra sodium EDTA), TSPP (tetrasodium pyrophosphate), TKPP (tripotassium polyphosphate), PAA (polyacrylic acid) and its salts, phosphonobutane carboxylic acid, and sodium gluconate. In one exemplary embodiment, the sequestrant comprises tetrasodium pyrophosphate.

The lubricant composition may comprise from about 0.005 to about 1 wt-%, about 0.01 to about 0.5 wt-%, about 0.02 to about 0.4 wt-%, about 0.03 to about 0.3 wt-%, or about 0.04 to about 0.1 wt-% of a sequestrant.

The lubricant composition can contain additional functional ingredients if desired. For example, the compositions can contain additional water miscible lubricants, hydrophilic diluents, antimicrobial agents, stabilizing/coupling agents, detergents and dispersing agents, anti-wear agents, viscosity modifiers, corrosion inhibitors, film forming materials, antioxidants, antistatic agents, or combinations thereof. The amounts and types of such additional components will be apparent to those skilled in the art. The functional ingredients can be selected so that they do not promote environmental stress cracking in plastic (e.g., PET) containers.

Exemplary formulations of the lubricant composition are shown in TABLE 1 below.

TABLE 1

Exemplary formulations of lubricant composition.

| | Formula A (wt-%) | Formula B (wt-%) | Formula C (wt-%) | Formula D (wt-%) |
|---|---|---|---|---|
| First lubricating agent | 0.2-90 | 1-60 | 2-30 | 5-20 |
| Second lubricating agent | — | 0.1-20 | 0.5-10 | 0.8-6 |
| Sequestrant | 0.005-1 | 0.005-1 | 0.01-0.5 | 0.01-0.2 |
| Emulsifier/stabilizer | 0.02-20 | 0.02-20 | 0.1-10 | 0.5-5 |
| Additional agents | 0-20 | 0-20 | 0-10 | 0-5 |
| Aqueous diluent | Balance | Balance | 40-98 | 65-95 |
| TOTAL | 100 | 100 | 100 | 100 |

Practical dispensing of conveyor lubricants requires careful control and maintenance of optimal lubrication between package and conveyor surfaces, as expressed as a coefficient of friction ("COF"), sliding force, slip value, frictional resistance or similar term. Generally, the objective for lubricant composition formulation and dispensing in prior art patents and published records is to produce the lowest possible coefficient of friction between conveyed packages and conveyor surfaces. In practice this does not result in effective conveying. In a practical implementation of a conveyor lubrication program, it is preferred to maintain a proper value for the coefficient of friction that is not necessarily the minimum possible value, as over-application of lubricant compositions and unacceptably low coefficient of friction between packages and the conveyor surface can result in decreased system efficiency due to tipped and fallen containers (e.g., bottles). Within the same conveyor line, the optimum coefficient of friction may be different at different locations on the track, and it may be desirable that the lubricant dispensing system be able to provide different values for the coefficient of friction at different locations on the same conveyor line without requiring different concentrations of lubricant.

In some embodiments, the present disclosure is directed to a "universal" lubricant that may be used with a variety of container and conveyor materials.

The lubricant composition can be used to convey a wide variety of containers including beverage containers; food containers; household or commercial cleaning product containers; and containers for oils, antifreeze or other industrial fluids. The containers can be made of a wide variety of materials including glasses; plastics (e.g., polyolefins such as polyethylene and polypropylene; polystyrenes; polyesters such as PET and polyethylene naphthalate (PEN); polyamides, polycarbonates; and mixtures or copolymers thereof); metals (e.g., aluminum, tin or steel); papers (e.g., untreated, treated, waxed or other coated papers); ceramics; and laminates or composites of two or more of these materials (e.g., laminates of PET, PEN or mixtures thereof with another plastic material). The containers can have a variety of sizes and forms, including cartons (e.g., waxed cartons or TETRAPAK™ boxes), cans, bottles and the like. The lubricant composition preferably contacts only parts of the container that will come into contact with the conveyor or with other containers.

A variety of kinds of conveyors and conveyor parts can be coated with the lubricant composition. Parts of the conveyor that support or guide or move the containers and thus are preferably coated with the lubricant composition include belts, chains, gates, chutes, sensors, and ramps having surfaces made of fabrics, metals, plastics, composites, or combinations of these materials.

In some embodiments, the lubricant composition is used to lubricate the passage of glass containers (e.g., glass bottles or cans) on a conveyor. For example, the lubricant composition may be used to lubricate the passage of glass containers on a stainless steel or plastic conveyor line. In one specific example, the lubricant composition is used to lubricate a conveyor used to convey glass bottles or cans on a stainless steel conveyor. In another exemplary embodiment, the lubricant composition is used to lubricate the passage of plastic containers (e.g., PET bottles) on a conveyor.

According to some embodiments, the lubricant composition is capable of maintaining a COF of 0.3 or lower, 0.25 or lower, 0.2 or lower, 0.15 or lower, or 0.13 or lower throughout the time of operating the conveyor and conveying containers on the conveyor. For example, the lubricant composition may be capable of maintaining a COF of about 0.08 to about 0.25, from about 0.09 to about 0.2, from about 0.1 to about 0.18, or from about 0.1 to about 0.15. The lubricant composition may be applied continuously or intermittently during the time of operating and conveying, and the lubricant composition is able to maintain a COF of 0.3 or lower, 0.25 or lower, 0.2 or lower, 0.15 or lower, or 0.13 or lower throughout the time of operating and conveying.

The lubricant composition may contain from about 50% to about 98% water or hydrophilic diluent as a component of the lubricant composition. The lubricant composition can be provided at a concentration and consistency that does not require dilution with water or with significant amounts of water. On the other hand, the lubricant composition can be diluted with water or an aqueous diluent at a diluent-to-lubricant ratio of about 1-500 parts diluent to 1 part lubricant, or at ratios of 1:1, 5:1, 30:1, 50:1, 100:1, 150:1, 200:1, 250:1, 300:1, 400:1, 500:1, 1000:1, or any ratio therebetween. The lubricant composition may be diluted prior to application, or at the time of application.

The aqueous diluent may be water that is available at the site of use, and may be used untreated (e.g., as is and not softened). In some aspects, the lubricant composition is compatible with water hardness. For example, the lubricant composition may have a tolerance for water hardness of 300 ppm or higher, 400 ppm or higher, or 500 ppm or higher. For example, the lubricant composition may have a tolerance for water hardness of about 250 ppm to about 550 ppm. The level of water hardness is measured as $CaCO_3$.

According to at least some embodiments, the lubricant composition has a viscosity that is similar to wet lubricants. This provides the benefit that the lubricant composition can be applied using standard equipment (e.g., non-energized nozzles) used to apply wet lubricants. Typical dry lubricants require specialized equipment (e.g., specialized dosing pumps and/or nozzles) that can add significant cost. The present lubricant composition can be applied with any suitable application system used to apply or dispense lubricants, including dosing pumps non-energized nozzles typically used with wet lubricants that generate a fine lubricant spray at low to moderate pressures between 5 psi and 80 psi, preferably between 20 psi and 60 psi, and have preferably between 30 psi and 50 psi. The application system may be configured to deliver between 0.1 gallons/hour and 10 gallons/hour (from 0.38 to 38 L/h), preferably between 0.25 gallons/hour and 7.5 gallons/hour (from 0.95 to 28 L/h) and more preferably between 0.5 and 5.0 gallons/hour (from 1.9 to 19 L/h).

The viscosity of the lubricant composition is about 0 to about 400 cP, about 10 to about 300 cP, or about 20 to about 200 cP.

The lubricant composition can be applied in a constant or intermittent fashion. By applying the lubricant coating in an intermittent fashion, the amount of applied lubricant composition can be minimized. It has been discovered that the present lubricant composition may be applied intermittently, while maintaining an optimum and sufficiently low coefficient of friction throughout the time of operating the conveyor and conveying containers on the conveyor. Specifically, the lubricant composition may be applied for a first period of time (the "applied time") and then not applied for a second period of time (the "not-applied time") of at least 1 minute, 2 minutes, 5 minutes, 10 minutes, 15 minutes, or at least 30 minutes or longer. The first period of time may be long enough to spread the composition over the conveyor belt (e.g., the duration of one revolution of the conveyor belt). During the first period of time, the actual application may be continuous, i.e., the lubricant composition is applied to the entire conveyor, or intermittent, i.e., the lubricant composition is applied in bands and the containers spread the lubricant composition around. One application cycle of the lubricant composition includes the first period of time when the lubricant composition is dispensed, and a second period of time, when the lubricant composition is not dispensed. The lubricant composition can be applied either to the conveyor directly, or to containers at an area that contacts the conveyor during conveying.

In some embodiments, the lubricant composition is applied for a first period of time of about 1 to about 120 seconds, or about 5 to about 60 seconds, and not applied for a second period of time of about 10 to about 500 seconds, or about 20 to about 360 seconds. The ratio of not-applied time to applied time may be from about 1 to about 100 units of not-applied time for every 1 unit of applied time, or from about 2 to about 50 units, from about 3 to about 30 units, or from about 5 to about 15 units of not-applied time for every 1 unit of applied time.

The lubricant composition exhibits good antimicrobial efficacy. In some embodiments, the lubricant composition can reduce *Pseudomonas aeruginosa* bacteria by at least 5 log, at least 6 log, or by at least 7 log. For example, the lubricant composition may be able to reduce *P. aeruginosa* by about 6 to about 8 log. The lubricant composition can also reduce *Saccharomyces cerevisiae* by at least 3 log, at least 4 log, or at least 5 log. For example, the lubricant composition may be able to reduce *S. cerevisiae* by about 4 to about 6 log.

The lubricant compositions of the present disclosure exhibit improved temperature stability over broad temperature ranges (e.g., below 4° C. and above 50° C.), freeze-thaw stability, improved compatibility with water hardness ions, excellent lubrication performance, and antimicrobial efficacy. The lubricant composition may be stable at temperatures ranging from about −40° C. to about 60° C. or from about −20° C. to about 55° C., and are stable through one or more (e.g., 1 to 10, or at least 3) freeze-thaw cycles. The lubricant composition includes one or more lubricating agents, including synthetic wax emulsions and/or amines and their derivatives. Suitable synthetic wax emulsions include polyethylene-based, poly(ethyleneoxide)-based, polypropylene-based, and poly(propyleneoxide)-based emulsions. In one embodiment, the synthetic wax emulsion includes poly(ethyleneoxide) wax emulsions. Suitable amine or amine derivative lubricants include oleyl diaminoalkanes (e.g., oleyl diaminopropanes), such as alkyl $C_{12}$-$C_{14}$ oxy propyl diamine or coco diamino propane, lauryl propyl diamine, dimethyl lauryl amine, and PEG coco amine. In one aspect, the lubricant composition includes a combination of two or more lubricating agents, such as a combination of a synthetic wax emulsion and an amine or amine derivative. In one exemplary embodiment, the lubricant composition includes a poly(ethyleneoxide) wax emulsion and oleyl diaminopropane. The lubricant composition may include from about 0.2 to about 90%, or from about 1 to about 75%, from about 2 to about 50%, or from about 5 to about 30% lubricating agents. In an example where the lubricant composition includes a first lubricating agent that is a synthetic wax emulsion and a second lubricating agent that is an oleyl diaminopropane, where the first lubricating agent is present at about 1 to about 60%, and the second lubricating agent is present at about 0.1 to about 10%. The first and second lubricating agents can be present at a ratio of about 1 to about 30 parts, about 2 to about 20 parts, or about 3 to about 10 parts of the first lubricating agent for every 1 part of the second lubricating agent. In one example, the lubricant composition includes about 7 to about 8 parts of first lubricating agent for every 1 part of the second lubricating agent. The lubricant composition may include one or more emulsifiers, stabilizing agents, or coupling agents to help keep the composition homogeneous under a broad temperature range. Various different types of compounds can be used as emulsifiers or stabilizers. Examples of suitable stabilizers include isopropyl alcohol, ethanol, urea, and the like. Suitable emulsifiers include various surfactants, such as cationic, anionic, nonionic, amphoteric, and zwitterionic surfactants. In one aspect, the lubricant composition includes an olefin sulfonate or a salt thereof. For example, the lubricant composition may include a long chain alkene sulfonate or long chain hydroxyalkane sulfonate, such as C14-C16 olefin sulfonate or a salt thereof. The lubricant composition may further include one or more sequestrants to improve hard water compatibility of the lubricant composition. Examples of suitable sequestrants include phosphonic acids and phosphonates, phosphates, aminocarboxylates and their derivatives, pyrophosphates, polyphosphates, ethylenediamene and ethylenetriamine derivatives, hydroxyacids, and mono-, di-, and tri-carboxylates and their corresponding acids. The lubricant composition may comprise from about 0.005 to about 1 wt-%, about 0.01 to about 0.5 wt-%, about 0.02 to about 0.4 wt-%, about 0.03 to about 0.3 wt-%, or about 0.04 to about 0.1 wt-% of a sequestrant. The lubricant composition may contain from about 50% to about 98% water or hydrophilic diluent as a component of the lubricant composition. The lubricant composition can be provided at a concentration and consistency that does not require dilution with any water of with significant amounts of water. Alternatively, the lubricant composition can be diluted with water or an aqueous diluent at a diluent-to-lubricant ratio of about 1-500 parts diluent to 1 part lubricant, or at ratios of 1:1, 5:1, 30:1, 50:1, 100:1, 150:1, 200:1, 250:1, 300:1, 400:1, 500:1, or any ratio therebetween. The lubricant composition can be dispensed through non-energized nozzles. The lubricant composition may be applied continuously or intermittently during the time of operating and conveying. The lubricant composition may be applied for a first period of time (the "applied time") and then not applied for a second period of time (the "not-applied time") of at least 15 minutes, at least 30 minutes, or at least 120 minutes or longer. In some embodiments, the lubricant composition is applied for a first period of time of about 1 to about 120 seconds, or about 5 to about 60 seconds, and not applied for a second period of time of about 10 to about 500 seconds, or about 20 to about 360 seconds. The ratio of not-applied time to applied time may be from about 1 to about 100 units of not-applied time for every 1 unit of applied time, or from about 2 to about 50 units, from about 3 to about 30 units, or from about 5 to about 15 units of not-applied time for every 1 unit of applied time. According to some embodiments, the lubricant composition is capable of maintaining a COF of 0.3 or lower, 0.25 or lower, 0.2 or lower, 0.15 or lower, or 0.13 or lower throughout the time of operating the conveyor and conveying containers on the conveyor. For example, the lubricant composition may be capable of maintaining a COF of about 0.08 to about 0.25, from about 0.09 to about 0.2, from about 0.1 to about 0.18, or from about 0.1 to about 0.15. The lubricant composition can reduce *Pseudomonas aeruginosa* bacteria by at least 5 log, at least 6 log, or by at least 7 log and *Saccharomyces cerevisiae* by at least 3 log, at least 4 log, or at least 5 log.

EXAMPLES

Example 1

Two lubricant formulations (Formula 1 and Formula 2) were prepared according to TABLE 2 and their performance was tested against commercially available semi-dry lubricant compositions. The stability of the lubricant compositions was also tested at various temperatures.

TABLE 2

Test formulations of lubricant composition.

| | Formula 1 (wt-%) | Formula 2 (wt-%) |
|---|---|---|
| First lubricating agent: poly(ethyleneoxide) wax emulsion | 15 | 15 |
| Second lubricating agent | 2 | 2 |
| Formula 1: isotridecyloxypropyl-1,3-diaminopropane | | |
| Formula 2: 1,3-Propanediamine,N1-(9Z)-9-octadecen-l-yl | | |
| Sequestrant: tetrasodium pyrophosphate | 0.05 | 0.05 |
| Emulsifier/stabilizer: sodium C14-16 olefin sulfonate | 2 | 2 |
| Aqueous diluent: DI water | 80.95 | 80.95 |
| TOTAL | 100 | 100 |

The viscosity of the lubricant formulations was monitored at 4 FC, ambient temperature, 40° C., and at 50° C. for 30 days. The results are shown in FIG. 1. It was observed that no significant changes in viscosity occurred during the 30-day period, and that the lubricant formulations had similar viscosities at both low and high temperatures as at ambient temperature.

Viscosity and phase separation (based on visual inspection) were also monitored throughout several freeze-thaw ("FT") cycles. In each freeze-thaw cycle, the samples were frozen at −18° C. for 24 hours, and then brought to ambient temperature (about 18-20° C.) for 24 hours, each cycle thus being 48 hours. After FT-cycles, the samples were stored for two weeks at ambient storage conditions and were visually inspected for phase separation after the two weeks of storage. The results are shown in TABLE 3 below.

TABLE 3

Freeze-thaw stability

| Sample | FT Cycle | Viscosity (cPS) | Visual | Pass or Fail |
|---|---|---|---|---|
| Formula1 | 1 | 14 | No separation | Pass |
| | 2 | 14 | No separation | Pass |
| | 3 | 16 | No separation | Pass |
| Formula2 | 1 | 12 | No separation | Pass |
| | 2 | 14 | No separation | Pass |
| | 3 | 14 | No separation | Pass |

It was observed that the lubricant formulations performed well, with minimal changes in viscosity after freeze-thaw cycles, and no visually perceptible phase separation after storage.

The lubricating performance of the lubricant formulations was tested against two commercially available formulations, Comparative formula 1 (fatty-amine based lubricant available from Ecolab Inc.) and Comparative formula 2 (a surfactant lubricant available from Ecolab Inc.). The formulations were tested on a stainless steel test conveyor with a length of 3 m and conveyor speed of 25 m/min. The test assembly included glass bottles arranged on the conveyor and attached to a tension meter to measure the Coefficient of Friction (COF) between the bottles and the conveyor. Each formulation was tested for 5 hours, and the last 30 min of data was collected and statistically analyzed. The test formulations were applied at a concentration of 0.4% and 0.6%. Comparative formula 1 was applied at 0.4%, and Comparative formula 2 at 0.6%. Each lubricant was tested in a semi-dry mode, where the application cycle was applied time 10 s, not-applied time 120 s.

Figure 2:
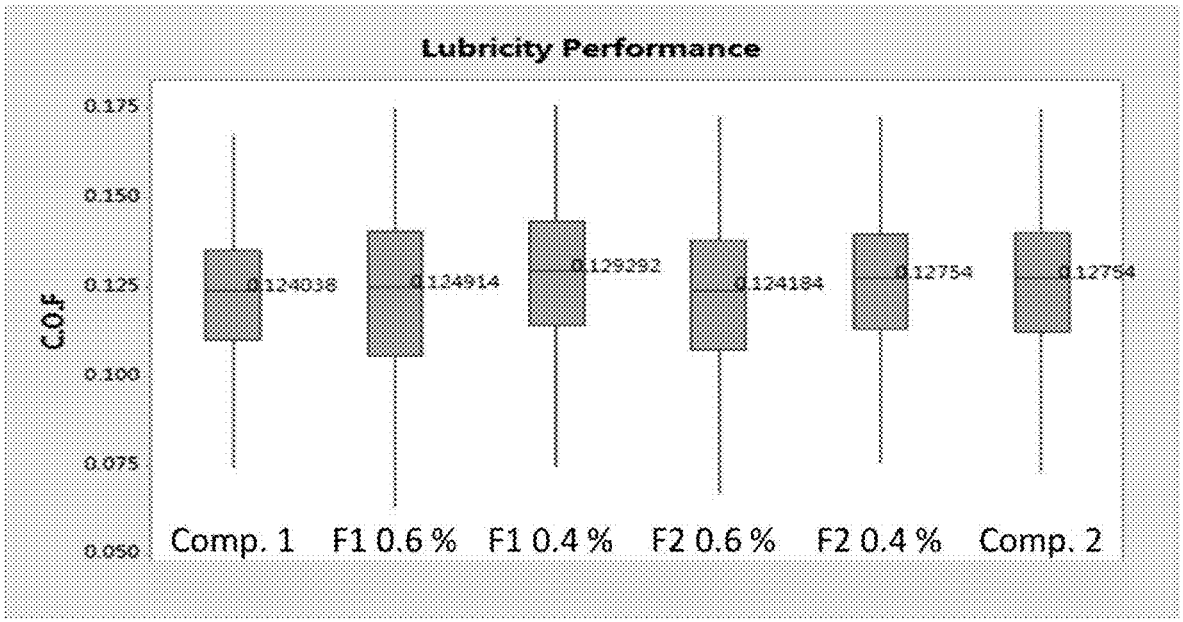
FIG. 2 is a graphical representation of data from Example 1.

The results of the lubricating test are shown in TABLE 4 and FIG. 2.

TABLE 4

| Lubricating performance | | |
|---|---|---|
| Formulation | Concentration | COF, Average |
| Comparative formula 1 | 0.40% | 0.124 |
| Comparative formula 2 | 0.60% | 0.128 |
| Formula 1 | 0.40% | 0.129 |
| Formula 1 | 0.60% | 0.125 |
| Formula 2 | 0.40% | 0.128 |
| Formula 2 | 0.60% | 0.124 |

It was observed that the test formulations performed equally well compared to the commercially available formulations, achieving very similar COF values.

The antimicrobial efficacy of the lubricant formulations against *Pseudomonas aeruginosa* and *Saccharomyces cerevisiae* was compared to Comparative formula 1. Each formulation was applied at a concentration of 0.5%. The formulations were applied to inoculums, which were then incubated for 48 hours. The results, including the number of survivors (CFU/mL) and log reduction, are shown in TABLE 5 below.

TABLE 5

| Antimicrobial efficacy at 48 h | | | | |
|---|---|---|---|---|
| Sample | Culture | Initial Count (CFU/mL) | Survivors (CFU/mL) | Log Reduction |
| Comparative formula 1 | *Pseudomonas aeruginosa* | $2.28 \times 10^7$ | 0 | ≥7.36 |
| Formula 1 | | | 0 | ≥7.36 |
| Formula 2 | | | 0 | ≥7.36 |
| Comparative formula 1 | *Saccharomyces cerevisiae* | $3.50 \times 10^5$ | 0 | ≥5.54 |
| Formula 1 | | | 0 | ≥5.54 |
| Formula 2 | | | 0 | ≥5.54 |

It was observed that the test formulations performed equally well compared to the commercially available formulation.

Compatibility of the lubricant formulations with water hardness ions was tested against Comparative formula 1. Samples of lubricant were mixed at a concentration of 0.5% with water having hardness levels ranging from 100 ppm to 400 ppm (measured as $CaCO_3$). Each of the samples was divided into three containers, one sealed with a lid and two left open for the duration of the test. The sample containers were stored at 40° C. for 7 days, after which the samples were observed for formation of a precipitate. The results are shown in TABLE 6 below.

TABLE 6

| Hardness tolerance | | | | |
|---|---|---|---|---|
| | Water Hardness | | | |
| Sample | 100 ppm | 200 ppm | 300 ppm | 400 ppm |
| Formula 1 | No prec. | No prec. | No prec. | No prec. |

TABLE 6-continued

| Hardness tolerance | | | | |
|---|---|---|---|---|
| | Water Hardness | | | |
| Formula 2 | No prec. | No prec. | No prec. | No prec. |
| Comparative formula 1 | No prec. | No prec. | No prec. | Precipitate |

It was observed that the test formulations had improved compatibility with water hardness ions as compared to the commercially available formulation.

Example 2

A lubricant formulation (Formula 3) was prepared according to TABLE 7 and tested against commercially available semi-dry lubricant compositions along with Formula 2 from Example 1. The stability of the lubricant compositions was also tested at various temperatures.

TABLE 7

| Test formulations of lubricant composition. | | |
|---|---|---|
| | Formula 2 (wt-%) | Formula 3 (wt-%) |
| First lubricating agent: poly(ethyleneoxide) wax emulsion | 15 | 15 |
| Second lubricating agent: 1,3-Propanediamine, N1-(9Z)-9-octadecen-1-yl | 2 | 2 |
| Sequestrant: tetrasodium pyrophosphate | 0.05 | 0.05 |
| Emulsifier/stabilizer: Formula2: sodium C14-16 olefin sulfonate Formula3: oleth-10 carboxylic acid | 2 | 0.5 |
| Aqueous diluent: DI water | 80.95 | 82.45 |
| TOTAL | 100 | 100 |

Viscosity of Formula 3 was monitored at 4° C., ambient temperature, 40° C., and at 50° C. for 30 days. The results are shown in TABLE 8. It was observed that no significant changes in viscosity occurred during the 30-day period at 4° C., ambient temperature, and at 40° C., and the viscosity at 50° C. remained within an acceptable range for 15 days.

TABLE 8

| Formula 3 viscosity (cPs) at different temperatures | | | | |
|---|---|---|---|---|
| Days | 4° C. | Ambient | 40° C. | 50° C. |
| 0 | 16 | 16 | 16 | 16 |
| 15 | 16 | 18 | 18 | 120 |
| 30 | 14 | 18 | 18 | 302 |

Viscosity and phase separation (based on visual inspection) were also monitored throughout several freeze-thaw ("FT") cycles. In each freeze-thaw cycle, the samples were frozen at −18° C. for 24 hours, and then brought to ambient temperature (about 18-20° C.) for 24 hours, each cycle thus being 48 hours. After FT-cycles, the samples were stored for two weeks at ambient storage conditions and were visually inspected for phase separation after the two weeks of storage. The results are shown in TABLE 9 below.

TABLE 9

| Freeze-thaw stability | | | | |
|---|---|---|---|---|
| Sample | FT Cycle | Viscosity (cPS) | Visual | Pass or Fail |
| Formula2 | 1 | 12 | No separation | Pass |
| | 2 | 14 | No separation | Pass |
| | 3 | 14 | No separation | Pass |
| Formula3 | 1 | 14 | No separation | Pass |
| | 2 | 16 | No separation | Pass |
| | 3 | 14 | No separation | Pass |

It was observed that the lubricant formulations performed well, with minimal changes in viscosity after freeze-thaw cycles, and no visually perceptible phase separation after storage.

The lubricating performance of the lubricant formulations was tested against Comparative formula 1 (fatty-amine based lubricant, commercially available from Ecolab Inc.). The formulations were tested on a stainless steel test conveyor with a length of 3 m and conveyor speed of 25 m/min. The test assembly included glass bottles arranged on the conveyor and attached to a tension meter to measure the Coefficient of Friction (COF) between the bottles and the conveyor. Each formulation was tested for 5 hours, and the last 30 min of data was collected and statistically analyzed. The test formulations were applied at a concentration of 0.4% and 0.6%. Comparative formula 1 was applied at 0.4%. Each lubricant was tested in a semi-dry mode, where the application cycle was applied time 10 s, not-applied time 120 s.

The results of the lubricating test are shown in TABLE 10.

TABLE 10

| Lubricating performance | | |
|---|---|---|
| Formulation | Concentration | COF, Average |
| Comparative formula 1 | 0.40% | 0.123 |
| Formula 2 | 0.40% | 0.127 |
| Formula 2 | 0.60% | 0.124 |
| Formula 3 | 0.40% | 0.127 |
| Formula 3 | 0.60% | 0.122 |

It was observed that the test formulations performed equally well compared to the commercially available formulations, achieving very similar COF values.

The antimicrobial efficacy of the lubricant formulations against *Pseudomonas aeruginosa* and *Saccharomyces cerevisiae* was compared to Comparative formula 1. Each lubricant was applied at a concentration of 0.2%. The formulations were applied to inoculums, which were then incubated for 48 hours. The results, including the number of survivors (CFU/mL) and log reduction, are shown in TABLE 11 below.

TABLE 11

| Antimicrobial efficacy at 48 h | | | | |
|---|---|---|---|---|
| Sample | Culture | Initial Count (CFU/mL) | Survivors (CFU/mL) | Log Reduction |
| Comparative | *Pseudomonas* | $1.66 \times 10^7$ | 0 | ≥7.20 |
| formula 1 | *aeruginosa* | | 0 | ≥7.20 |
| Formula 2 | | | 0 | ≥7.20 |
| Formula 3 | | | | |
| Comparative | *Saccharomyces* | $1.40 \times 10^6$ | 0 | ≥6.15 |
| formula 1 | *cerevisiae* | | 0 | ≥6.15 |
| Formula 2 | | | 0 | ≥6.15 |
| Formula 3 | | | | |

It was observed that the test formulations performed equally well compared to the commercially available formulation.

Compatibility of the lubricant formulations with water hardness ions was tested against Comparative formula 1. Samples of lubricant were mixed at a concentration of 0.2% with water having hardness levels ranging from 100 ppm to 400 ppm (measured as $CaCO_3$). Each of the samples was divided into three containers, one sealed with a lid and two left open for the duration of the test. The sample containers were stored at 40° C. for 7 days, after which the samples were observed for formation of a precipitate. The results are shown in TABLE 12 below.

TABLE 12

| Hardness tolerance | | | | |
|---|---|---|---|---|
| | Water Hardness | | | |
| Sample | 100 ppm | 200 ppm | 300 ppm | 400 ppm |
| Formula 2 | No prec. | No prec. | No prec. | No prec. |
| Formula 3 | No prec. | No prec. | No prec. | No prec. |
| Comparative formula 1 | No prec. | No prec. | No prec. | Precipitate |

It was observed that the test formulations had improved compatibility with water hardness ions as compared to the commercially available formulation.

The stability of the formulations was tested when exposed to open air. The appearance of each formulation was recorded at 2 days, 7 days, and 3 weeks. The results are shown in TABLE 13 below.

TABLE 13

| Expose to air | | | |
|---|---|---|---|
| | Appearance | | |
| Sample | 2 days | 7 days | 3 weeks |
| Formula 1 | separation | viscosity increased, cannot disperse in water | solidification, yogurt-like appearance |
| Formula 2 | separation | viscosity increased, cannot disperse in water | solidification, yogurt-like appearance |

TABLE 13-continued

| Expose to air | | | |
|---|---|---|---|
| | Appearance | | |
| Sample | 2 days | 7 days | 3 weeks |
| Formula 3 | slight separation | slight separation | separation, viscosity up to about 300cPs |

Separation of Formulas 1 and 2 was observed after two days of exposure to air. The viscosity of Formulas 1 and 2 Formula 3 was increased after one week, and the formulas had a thick, yogurt-like appearance after three weeks. Formula 3 was more stable, and exhibited only slight separation after one week, and separation and a slight increase in viscosity at three weeks.

Example 3

Experimental formulations E1, E2, and E3 were prepared according to TABLE 14. The stability of the formulations was evaluated by monitoring separation and viscosity.

TABLE 14

| Alternative formulations | | | |
|---|---|---|---|
| | Formula E1 (wt-%) | Formula E2 (wt-%) | Formula E3 (wt-%) |
| First lubricating agent: poly(ethyleneoxide) wax emulsion | — | — | 15 |
| Second lubricating agent: 1,3-Propanediamine,N1-(9Z)-9-octadecen-1-yl | 5 | 5 | |
| Sequestrant: tetrasodium pyrophosphate | 0.05 | 0.05 | 0.05 |
| Glycerol | 15 | — | — |
| C11-14-iso, C13-rich ethoxylated alcohols | 2 | 1 | — |
| sodium C14-16 olefin sulfonate | — | 3 | — |
| oleth-10 carboxylic acid | — | — | — |
| Antimicrobial: methylchloroisothiazolinone | — | — | 2 |
| Aqueous diluent: DI water | 77.95 | 90.95 | 82.45 |
| TOTAL | 100 | 100 | 100 |

The viscosity of Formula E1 was found to become unacceptably high at 50° C. within 3 days. Formula E2 began to separate at 50° C., and the viscosity of the formulation increased during freeze-thaw cycles. Formula E3 exhibited solidification within 3 days at 40° C. and 50° C.

While certain embodiments of the invention have been described, other embodiments may exist. While the specification includes a detailed description, the invention's scope is indicated by the following claims. The specific features and acts described above are disclosed as illustrative aspects and embodiments of the invention. Various other aspects, embodiments, modifications, and equivalents thereof which, after reading the description herein, may suggest themselves to one of ordinary skill in the art without departing from the spirit of the present invention or the scope of the claimed subject matter.

What is claimed is:

1. A method for lubricating the passage of a container along a conveyor, the method comprising:

applying a lubricant composition to at least a part of the container or the conveyor during operation, the lubricant composition comprising:

a synthetic wax emulsion comprising a synthetic wax and an emulsifier, the synthetic wax having a molecular weight of about 5,000 to about 60,000; and an amine or amine derivative;

wherein the lubricant composition is applied intermittently.

2. The method of claim 1, wherein the synthetic wax is selected from the group of polyethylene-based polymers, polypropylene-based polymers, copolymers of polyethylene and polypropylene, polyethylene-maleic copolymers, and polypropylene-maleic copolymers.

3. The method of claim 1, wherein the synthetic wax emulsion is a polyethylene wax emulsion or polypropylene wax emulsion.

4. The method of claim 1, wherein the lubricant composition is substantially free of natural waxes.

5. The method of claim 1, wherein the amine or amine derivative is selected from the group of fatty amines, ether amines or salts thereof, oleyl diaminopropane, alkyl C12-C14 oxy propyl diamine, coco diaminopropane, lauryl propyl diamine, dimethyl lauryl amine, and PEG coco amine.

6. The method of claim 1, wherein the amine or amine derivative is a diaminoalkane or derivative thereof.

7. The method of claim 1, wherein the amine derivative comprises alkyl C12-C14 oxypropyl diamine.

8. The method of claim 1, wherein the emulsifier comprises a surfactant.

9. The method of claim 1, wherein the emulsifier comprises an anionic surfactant.

10. The method of claim 1, wherein the emulsifier is present at about 0.1 to about 10 wt. % of the lubricant compositions.

11. The method of claim 1, the lubricant composition further comprising a sequestrant.

12. The method of claim 11, wherein the sequestrant comprises a phosphate.

13. The method of claim 11, wherein the sequestrant is present at about 0.01 to about 1 wt. % of the lubricant composition.

14. The method of claim 1, wherein the lubricant composition is a concentrate comprising:

from about 5 to about 90 wt. % of the synthetic wax emulsion; and from about 0.5 to about 20 wt. % of the amine derivative, and wherein the method further comprises diluting the lubricant composition with water.

15. The method of claim 1, wherein the synthetic wax emulsion and the amine or amine derivative are present at a ratio of from about 2 to about 20 parts synthetic wax emulsion for every 1 part of amine or amine derivative.

16. The method of claim 1, wherein the method results in a coefficient of friction of about 0.08 to about 0.2 between the container and the conveyor.

17. The method of claim 1, wherein the lubricant composition is applied through non-energized nozzles.

18. The method of claim 1, wherein the intermittent application applies the lubricant composition for a first period of time and does not apply the lubricant composition for a second period of time and the first period of time is shorter than the second period of time.

19. The method of claim 1, wherein the intermittent application applies the lubricant composition for a first period of time and does not apply the lubricant composition for a second period of time and the first period of time has a first length and the second period of time has a second length, and wherein the first length and the second length have a ratio from 1:1 to 1:100.

20. The method of claim 18, wherein the first period of time is from about 1 to about 60 seconds and the second period of time is from about 10 to about 3600 seconds.

* * * * *